US011383115B1

(12) United States Patent
Rousseau et al.

(10) Patent No.: US 11,383,115 B1
(45) Date of Patent: Jul. 12, 2022

(54) SMART FIRE EXTINGUISHER

(71) Applicants: Hector Rousseau, Riverside, CA (US); Randy Rousseau, Riverside, CA (US)

(72) Inventors: Hector Rousseau, Riverside, CA (US); Randy Rousseau, Riverside, CA (US)

( * ) Notice: Subject to any disclaimer, the term of this patent is extended or adjusted under 35 U.S.C. 154(b) by 125 days.

(21) Appl. No.: 16/359,819

(22) Filed: Mar. 20, 2019

Related U.S. Application Data

(60) Continuation-in-part of application No. 15/366,828, filed on Dec. 1, 2016, now abandoned, which is a division of application No. 14/745,135, filed on Jun. 19, 2015, now abandoned, which is a continuation-in-part of application No. 14/480,475, filed on Sep. 8, 2014, now abandoned.

(51) Int. Cl.
*A62C 13/74* (2006.01)
*A62C 37/50* (2006.01)
*A62C 13/76* (2006.01)

(52) U.S. Cl.
CPC ..... *A62C 37/50* (2013.01); *A62C 13/74* (2013.01); *A62C 13/76* (2013.01)

(58) Field of Classification Search
CPC ..... A62C 13/00; A62C 13/50; A62C 13/75; A62C 13/78
USPC ..... 169/51
See application file for complete search history.

(56) References Cited

U.S. PATENT DOCUMENTS

| | | | |
|---|---|---|---|
| 674,827 | A | 5/1901 | Edmands |
| 907,029 | A | 12/1908 | Giseke |
| 1,272,012 | A | 7/1918 | Connor |
| 1,354,093 | A | 9/1920 | Davidson |
| 1,733,724 | A | 10/1929 | Downs |
| 1,790,231 | A | 1/1931 | Dugas |
| 2,017,319 | A | 10/1935 | McMullen |
| 2,067,829 | A | 1/1937 | Dennel |
| 2,208,490 | A | 7/1940 | Axtell et al. |
| 2,430,470 | A | 11/1947 | Keefe, Jr. |
| 2,533,685 | A | 6/1949 | Nurkiewicz |
| 2,489,339 | A | 11/1949 | Stroop |
| 2,541,554 | A | 2/1951 | Smith |
| 2,569,975 | A | 10/1951 | Cone |
| 2,592,029 | A | 4/1952 | Hansen |

(Continued)

FOREIGN PATENT DOCUMENTS

| | | |
|---|---|---|
| CN | 201603325 | 10/2010 |
| EP | 0298022 | 1/1989 |

(Continued)

*Primary Examiner* — Jason J Boeckmann

(74) *Attorney, Agent, or Firm* — Kirk A. Buhler; Buhler & Associates Patenting

(57) ABSTRACT

Improvements to a portable fire extinguisher where the improvements relate to a system where the owner of the extinguisher can monitor and maintain their fire protection. The improvements also include integration of technology into the fire extinguisher for real-time information of the status around the extinguisher, pre-recorded instructions in one or multiple languages. The technology can also include bi-directional communication whereby a user can communicate to a distant operator. With the inclusion of a speaker the fire extinguisher can provide safety and public service announcements using a wireless WiFi communication network without requiring separate speakers to be wired and connected throughout a building.

19 Claims, 7 Drawing Sheets

(56) References Cited

U.S. PATENT DOCUMENTS

| | | | | |
|---|---|---|---|---|
| 2,785,759 | A | 3/1957 | Fleming et al. | |
| 2,796,135 | A | 6/1957 | Nurkiewicz | |
| 3,149,677 | A | 9/1964 | Blair | |
| 3,251,420 | A | 5/1966 | Rodgers | |
| 3,255,824 | A | 6/1966 | Rodgers | |
| 3,618,669 | A | 11/1971 | Sachs | |
| 3,667,549 | A | 6/1972 | Sachs | |
| 3,713,493 | A | 1/1973 | Hansen | |
| 3,719,232 | A | 3/1973 | Gubela | |
| 3,858,659 | A | 1/1975 | Fukushima | |
| 4,303,395 | A * | 12/1981 | Bower | G08B 3/10 169/61 |
| 4,372,394 | A | 2/1983 | Allegri, Sr. | |
| 4,505,336 | A | 3/1985 | Thevis et al. | |
| 4,567,948 | A | 2/1986 | Roznieck | |
| 4,650,004 | A | 3/1987 | Wendling et al. | |
| 4,705,064 | A | 11/1987 | Self | |
| 4,862,968 | A | 9/1989 | Woodman | |
| 6,029,751 | A * | 2/2000 | Ford | A62C 35/023 169/60 |
| 6,179,438 | B1 * | 1/2001 | Parker | F21L 4/085 362/183 |
| 6,189,624 | B1 | 2/2001 | James | |
| 6,302,218 | B1 * | 10/2001 | McSheffrey | A62C 13/76 169/51 |
| 6,378,740 | B1 | 4/2002 | Martin | |
| 6,527,058 | B1 | 3/2003 | Nerat | |
| 6,690,288 | B1 * | 2/2004 | Waddell | G08B 7/062 340/539.11 |
| 8,842,016 | B1 * | 9/2014 | Cazanas | A62C 37/50 340/611 |
| 9,144,699 | B1 | 9/2015 | Wang | |
| 2004/0166266 | A1 | 8/2004 | De Wit | |
| 2005/0060953 | A1 | 3/2005 | Altonen et al. | |
| 2006/0032642 | A1 | 2/2006 | Jacobson | |
| 2007/0102167 | A1 | 5/2007 | Rousseau | |
| 2007/0147038 | A1 * | 6/2007 | Bahorun | A62C 13/76 362/253 |
| 2009/0188681 | A1 | 7/2009 | Chang | |
| 2014/0328076 | A1 * | 11/2014 | Firman, II | B60Q 3/62 362/511 |

FOREIGN PATENT DOCUMENTS

| | | |
|---|---|---|
| EP | 1961458 | 4/2011 |
| GB | 447936 | 5/1936 |
| GB | 1199139 | 7/1970 |
| GB | 1259261 | 1/1972 |
| JP | 09225056 | 9/1997 |
| RU | 2209101 | 7/2003 |

* cited by examiner

SMART FIRE EXTINGUISHER

CROSS REFERENCE TO RELATED APPLICATION

This application is a continuation-in-part of applicant's co-pending application Ser. No. 15/366,828 filed on Dec. 1, 2016 which is a Divisional application of applicant's co-pending application Ser. No. 14/745,135 that was filed on Jun. 19, 2015 and is a continuation-in-part of applicant's co-pending application Ser. No. 14/480,475 that was filed on Sep. 8, 2014.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in portable fire extinguishers or delivery system. More particularly, the present invention relates to a fire extinguisher that allows for external mixing, fluffing, actuating or stirring of the powder within the chamber to provide anti-bridging of the powder to keep it in a liquefied state. The improvements further include a communication link that identifies the status and location of the fire extinguisher.

Description of Related Art Including Information Disclosed Under 37 CFR 1.97 and 1.98

Most portable fire extinguishers are of a similar design where the fire extinguishing powder is contained in a pressurized chamber. Fire extinguishers of this type require scheduled maintenance because the powder within the chamber can settle and cake preventing it from being dispensed when needed. The pressure within the chamber may also leak over time and be insufficient to propel the powder out of the dispensing nozzle. A further limitation, based upon this design is due to the pressurized condition of the chamber, powder is placed into the chamber in a small opening in the top of the extinguisher. This scheduled maintenance allows moisture intrusion causing caking. Current extinguishers can only be service by trained certified technicians, and the certification is issued by the fire marshal for each state. The current fire system in place today requires the serviced of a third party. The service companies (third parties) are charged with maintaining the system. They cannot in fact meet the standards required of them. They cannot meet the requirements of the UL label. Nor can they meet the manufacturer's requirements.

UL states each extinguisher must be maintained in the same manner as it was tested. The powder must be the manufacturer's powder. The lubricants must be the same manufacturer's brand. The hanger must be of the same manufacturer. If these requirements are not met the UL listing is voided and the extinguishers must be recalled. It is impossible for any service company to meet these requirements. All service firms perform the maintenance of the extinguishers in service vehicles. These vehicles are small vans or pick-up trucks. They can carry at most two recovery systems, one for ABC and one for BC. There are no service vehicles capable of carrying a recovery system for each brand of extinguisher as required by UL. All extinguishers in service today have contaminated powder and the UL has been voided. This also speaks to the lubricants and parts as well.

The manufacturer and NFPA-10 standards also impose standards that cannot be met by the service firms. The manufacturers require that only their powder, parts and lubricants must be used in their products. They also require standard for the servicing of the same. The concern for the environmental impact on their powder i.e. the humidity level, the amount of air the powder is exposed too, the mixing of powder. The manufacturers produce their product in a controlled environment and as such can protect against caking and therefore maintains a fluid effect with the powder. The current extinguishers use chemical recycled thru a recovery system thus the mixing of chemicals. This extinguisher has the only enclosed chemical cartridge and no mixing of the chemical can take place.

Mixing the powder and using their own brand of lubricants and parts they allow an abundance of air in various stages to compromise the powder. Currently the only prevention for this is to never open the extinguisher and to return it to the manufacturer when it is required to be hydro tested or to have the six-year tear down to clear the powder. It is commonly understood that because the current system is made up of pressurized portable fire extinguishers resulting in the compaction of the powder and therefore must be fluffed. The current system is plagued with serious problems. The service firms have very little supervision and are in a position to abuse the public. Most enforcement officers are charged with other more serious duties, i.e. arson etc. and has little time to dedicate to a system that is in fact impossible to maintain. The vast majorities of service firms operate out of the back of their trucks and are continually on the move, making them difficult to locate and to implement any type of enforcement.

Another limitation with portable fire extinguishers that are currently available is that the fire extinguishers can only be shipped by land because they are pressurized, and could rupture when they are shipped by air. The ground shipping is a HASMAT requirement that the proposed portable fire extinguisher would not have because the tank is not pressurized.

Current extinguishers are open to wear and tear because of the constant pressure and the tear down process. When serviced they are fired into a recycling chamber and all the parts must be disassembled and cleaned. All the pressure rings must be replaced and every part must them be reassembled with new powder being placed within the chamber prior to pressurizing the chamber. The servicing of current fire extinguishers often creates more wear and tear on the fire extinguisher than when it is used to extinguish a fire.

U.S. Pat. No. 6,189,624 issued to James on Feb. 20, 2001 and Japan Patent Number JP9,225,056 issued to Yamazaki Tomoki on Sep. 2, 1997 disclose fire extinguishing mechanisms where the chamber is not continuously pressurized, and the pressurized chamber is a separate entity integrated within the chamber. While these patents disclose a separate pressurized canister, the canister is not located in a position that is easy to service, replace, or inspect. This minimizes the ability determine the charge level of the $CO_2$ cartridge.

U.S. Pat. No. 2,541,554 issued to C H Smith on Feb. 13 1951 and Russian Patent Number RU 2,209,101 issued to Glavatski G. D. Et Al. Nov. 2, 2002 discloses a fire extinguisher with external $CO_2$ gas cartridge. In the case US '554 the $CO_2$ gas cartridge sits on top of the fire extinguisher chamber and is not integrated within the handle of the fire extinguisher. In the case of RU '101 the $CO_2$ gas cartridge is external to the extinguisher and is connected to the extinguisher with a pipe or hose. While both of these patents disclose a $CO_2$ cartridge that is external to the chamber, neither of them is placed in the handle to allow a configuration of the fire extinguisher that is simple to inspect and replace.

Russian Patent Number RU2,209,101 issued to Glavatski G. D. Et Al. Nov. 2, 2002 discloses a fire extinguisher with an internal fluffing mechanism consisting of a coiled spring. It is known that one of the problems with powder type fire extinguishers is the possibility that the extinguishing powder within the chamber can cake and harden if it is not fluffed to keep the powder in liquid configuration. While the RU '101 patent discloses a fluffing mechanism, the fluffing mechanism is operated by a wound spring, and once the spring has been used there is no mechanism to wind the spring. The proposed product does not have this limitation because it provides an external mechanical interface that allows a user to manually fluff the powered.

Due to the pressurized condition that exists with pressurized fire extinguishers, the opening where powder is placed into the extinguisher is limited due to the structural requirement to maintain pressure within the chamber at all times. The proposed application eliminates this need by providing an external pressurized gas cartridge, thus allowing the chamber to exist in a normally un-pressurized condition. Because the chamber is not under pressure the top opening of the extinguisher can be enlarged to allow easier filling of the fire extinguisher with powder, or checking the amount and or condition of the powder within the chamber. This extinguisher does not require this testing, it is not pressurized constantly, only when it is needed to extinguish a fire and then it only holds pressure for the maximum of a minute.

A number of patents have been issued that include an audible alarm to indicate that a fire extinguisher has been moved or taken. Exemplary examples of these patents include U.S. Pat. No. 4,360,802 issued to Anthony A. Pinto on Nov. 23, 1982, U.S. Pat. No. 4,592,301 issued to Anthony J. Monte on Jun. 3, 1986 and U.S. Pat. No. 3,893,095 issued to Dennis E. DeJong on Jul. 1, 1975. While these patents disclose a signaling means to announce that the fire extinguisher has been removed, none of them disclose a means of wireless connectivity to provide real time information and data sharing, nor do they provide for a mixing mechanism for fluffing the internal contents of the fire extinguisher.

The conventional bracket in use today has no deterrents regarding tampering. The tamper seal (plastic strap) is easily broken and the safety pin is accessible to anyone wanting to remove it, i.e. disgruntled employees, customers etc. If either the strap or the pin is tamper with that extinguisher must be fired off and broken down and totally cleaned and refilled and re-certified.

What is needed is a fire extinguisher with an external gas cartridge where the gas cartridge is located in the handle, a fluffer that is accessible from outside the chamber. The ideal product would also include a wall mounting bracket for the extinguisher that has a mechanical fluffing mechanism. The ideal wall mounting bracket would also have a protector for the activation mechanism of the fire extinguisher with communication to a separate computer that provides information on the status of the fire extinguisher. The proposed fire extinguisher provides this solution by providing a fire extinguisher and a wall mounting bracket with the features needed.

BRIEF SUMMARY OF THE INVENTION

It is an object of the fire extinguisher to eliminate the need for service personnel to enter secure areas. The extinguisher can have a higher level of service. Can be operated automatically "self-reliant" and or manually serviced by the owner or end user. This eliminates the need for non-employees to enter the privacy of business and government areas. This extinguisher can be operated, maintained, refilled and charged with no special training or equipment allowing for anyone who purchases it to have it function like any of the office equipment that is available to day like a copier, printer or water cooler. The proposed fire extinguisher is not required to be broken down when it has been fired or any device designed for self-service by individual employees engaged working with office equipment like a printer, water cooler or coffee maker or copiers that are complicated and require service and repair by technicians that have specialized skills.

The reduced outside servicing and maintenance of the fire extinguisher is ideal for placement of the fire extinguisher to be placed in secure areas. This will reduce or eliminate the possibility that a terrorist could utilize the fire extinguisher as a weapon, or use false identity as an extinguisher service person to gain access to a secure area.

It is an object of the fire extinguisher to provide a fire extinguisher with an external pressurized canister. The external canister allows the chamber to exist at or near ambient pressure that reduces the need to utilize a high strength chamber. The standard pressurized cartridge that is used in other applications can be easily adapted to operate with the fire extinguisher. Since the pressurized cartridge is external to the chamber it can be easily replaced or swapped without replacing the entire fire extinguisher. This provides a tremendous benefit when a large number of fire extinguishers need to be in service at one time.

It is another object of the fire extinguisher to provide a fire extinguisher with an externally accessible fluffing mechanism. The externally accessible fluffing mechanism promotes anti-bridging of the powder within the chamber to keep it fluffed, agitated, stirred or disturbed to prevent caking of the powder and keep the powder in a liquefied state so it is easier to spray the powder onto a fire. The fluffing is accomplished with paddles, flapper, chains rods or other mixing mechanisms located within the chamber. The mixing mechanism is accessed by a connection on the top, bottom or side of the chamber and can be either manually operated or operated with a key of some type.

It is another object of the fire extinguisher to provide automatic fluffing of the media inside the fire extinguisher using a powered fluffing mechanism that is powered with batteries, wind-up mechanism or is externally powered. A timing device can be used to fluff the contents at pre-defined intervals, or the mixing can be performed continuously at a pre-defined rate of rotation.

It is another object of the extinguisher to provide an extinguisher where there is no need for any tear down because the powder is contained in the manufacturer's cartridge and the powder can be fluffed by the external mechanism at the base of the cartridge. The fluffier can be operated manually or with an electric motor, hard wired or battery operated. This extinguisher can be produced with a clear powder cartridge and the fluffing can be visibly inspected. This extinguisher provides the operator with several options such as the ability to recharge and fire as needed and to fire different fire retardant and it can also fire a liquid product. Fire departments can fire and recharge at the site, they no longer have to wait for a service firm to recharge the extinguisher.

It is another object of the extinguisher to provide a delivery system that accommodated as much chemical as the cartridges available at the scene, five, ten, twenty, thirty, forty etc. without providing a limitation based upon the chemical and extinguisher sizes that are currently available.

It is another object of the fire extinguisher to provide a fire extinguisher that can be filled or refilled with a changeable canister of fire-resistant material. The canister consists of a cup shaped cylinder that can be slid into the bottom or top of the fire extinguisher. Various types of fire extinguishing media can be installed and or changed by removing the bottom or top of the extinguisher and sliding a new or different type of fire extinguishing media inside of the fire extinguisher shell, and re-installing the bottom or top.

It is another object of the fire extinguisher to embed the fire extinguishing media with quantum dot particles. The quantum dot particles provide a confirmation that the fire extinguishing media is the required quality and retains the UL requirements without being tampered. This also ensures that the fire extinguishing media is not diluted or mixed with other fire extinguishing media that would compromise the effectiveness of the fire extinguishing media.

It is another object of the fire extinguisher to provide a fire extinguisher that can be shipped by overnight or air carrier. Since the fire extinguisher exists in a non-pressurized condition there is no hazard of explosion of the pressurized canister. The pressurized canister is inserted into the fire extinguisher when it arrives at its destination.

It is another object of the fire extinguisher to provide a delivery system which dispenses various types of fire retardant and can be reused at the point of attack without the need for special pressurized equipment or specially trained certified personnel. This extinguisher is specially designed so that all parts are interchangeable. These features provide a wider range of fire suppression available for the on-line fire fighters.

It is another object of the fire extinguisher to provide a fire extinguisher with interchangeable parts where the heads and cylinders of each of the extinguishers can be interchanged with the head and cylinder from another fire extinguisher. Today each extinguisher must be refitted with the head it was manufactured with. If the heads are not replaced on the manufactured cylinder the instruction labels and the gauges do not line up and the extinguisher must be condemned. The current extinguishers display the instructions on the left side of the extinguisher and the safety pin is on the left side of the extinguisher, the gauge is on the left side of the extinguisher each of these make it difficult for the user who is right handed. This extinguisher has the instructions on the top, making it easier for both the right and left handed users.

It is another object of the fire extinguisher to provide a fire extinguisher that does not have a gauge. The current extinguishers cannot be refilled or recharged by the owner they must be recharged and pressurized by a third party. This extinguisher can be recharged by the end user, the owner. Current extinguishers can only be used with the designated powder it is filled with and because each extinguisher is pressurized it can only be recharged by a certified technician with the necessary pressurizing equipment. This extinguisher has a cartridge loaded powder with a fluffing mechanism and is interchangeable for whatever retardant is required. It is not pressurized and can be changed by the operator. This extinguisher is only pressurized when it is needed to extinguish a fire. Current extinguishers are pressurized at 195 PSI and over a period time this creates compacting and bridging and the pressure can leak out of the cylinder.

It is another object of the fire extinguisher that includes the chemical cartridge and the fluffier and the head (delivery system) in a complete unit. The major uniqueness is the overall user-friendly system. This extinguisher is a system for the multi delivery of fire retardant. This extinguisher eliminates the need for a government regulated ineffective third party and places the responsibility for protection in the hands of the individual. The current extinguisher requires a separate extinguisher for each chemical retardant, i.e. ABC, BC, Purple K etc. This extinguisher with its delivery head can apply all chemicals.

It is another object of the fire extinguisher to provide a fire extinguisher that can deliver as much retardant and the correct type of retardant called for at the immediate fire location. With the proposed fire extinguisher, the fire retardant is no longer limited by the delivery system. The retardant can be available on the fire fighter's equipment and can be dispensed at the scene. The proposed fire extinguisher has the chemical separately contained in fire resistant plastic cartridges that are clearly marked with the corresponding chemicals required for the immediate fire threat.

It is another object of the fire extinguisher to provide a fire extinguisher with a wall mounted bracket that has tamper deterrent the base of the bracket extends to cover the safety cover over the pressurizing trigger. The safety strap and the pull pin have been replaced on the eliminator extinguisher. This cartridge operated extinguisher has a pressure trigger which is protected by a safety cover. The design of this bracket provides a double safety feature. When the extinguisher is placed into the bracket the top is secure by a cover that snaps over the top of the extinguisher. The extinguisher must be removed and the second deterrent must be violated to fire the extinguisher.

It is another object of the fire extinguisher bracket to have additional features such as a simple plunger device which can be attached to the base of the bracket and will the activated if the extinguisher is removed, a flashing light can also be attached to add to the deterrent and to notify others regarding the location of a fire or where an extinguisher has been removed.

It is another object of the fire extinguisher bracket for the bracket to be fabricated in a material that glows in the dark material which would assist in the event of a power loss and would function as a night light.

It is still another object of the fire extinguisher or bracket to have a transmitter that transmits information regarding the location of the fire extinguisher, conditions of the environment around the fire extinguisher and the status of the fire extinguisher. This information can be displayed on a map to provide graphical or numerical information at a distant location so a fire fighter can obtain an overall understanding where a fire or hotspot exists. Geolocation informationally can be provided in graphic form on a digital map or other alpha-numerical data and information for display at remote locations or to safety monitoring networks and institutions so fire fighters and where a fire or hot spot exists as well as conditions to expect on arrival. This also provides a two-way communications platform to the fire extinguisher user and/or a fire fighter.

It is still another object of the fire extinguisher to include a communications system that can include pre-recorded information and instruction regarding using the fire extinguisher, status including fire extinguisher capacity, volume/use remaining. The pre-recorded use information can be in multiple languages so a person can receive verbal instructions why they operate the fire extinguisher. The communication system can also include bi-directional communication whereby a user can communicate to a distant operator. With the inclusion of a speaker the fire extinguisher can provide safety, music and public service announcements using a wireless WiFi communication network radio, wireless network and gateway facilities without requiring separate speakers to be wired and connected throughout a building.

It is still another object of the fire extinguisher for the extinguisher to have a fluffing wheel that is designed specifically for the eliminator extinguisher. It can be operated by hand or powdered. The wheel is attached at the base of the extinguisher. The fluffing wheel is snapped on to the internal agitator. It is easily activated and if the operator finds the wheel difficult to turn the entire powder cartridge should be replaced. The chamber is not pressurized so the powder should be fluffed without any difficulty. The fluffing wheel is operable with a fluffing chuck that is designed specifically for the fluffing wheel. The cluck fits any of the current drills in use today. It is circular and has multiple extended arms which fit into the fluffing wheel attached to the base of the extinguisher.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
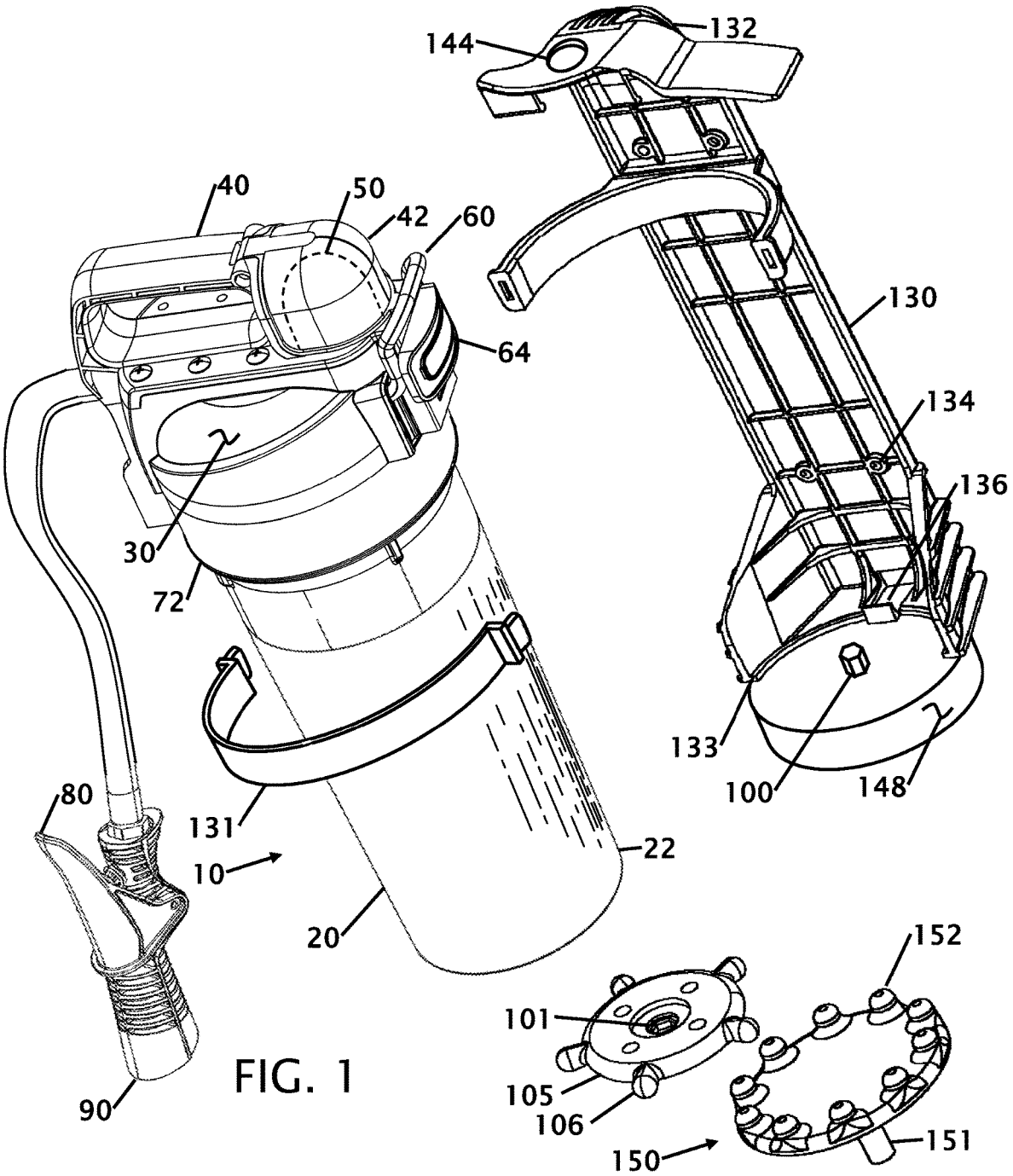
FIG. 1 shows an isometric view of the self-reliant fire extinguisher, mounting bracket, fluffing wheel and the fluffing chuck.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, but is merely representative of various embodiments of the invention. The illustrated embodiments of the invention will be best understood by reference to the drawings, wherein like parts are designated by like numerals throughout.

ITEM NUMBERS AND DESCRIPTION

10 fire extinguisher
20 chamber
22 bottom
28 enlarged opening
30 top
31 bar code
33 illuminated ring/band
34 light
40 handle
41 wall mount
42 cover
43 front lip
44 back
45 spaces
46 saddle
47 screws
48 power cord
50 canister
60 trigger
64 rotating mechanism
70 fire suppressant media
72 enlarged opening
80 valve
90 nozzle
92 hole
98 rotated
99 lifted
100 terminates
101 geometric opening
102 opening
103 transmission
104 holes
105 knob
106 arms
108 shaft
109 bottom
110 appendage
111 base
112 riser
114 secured
115 concentric rings
116 concentric rings
117 location
120 mechanism
128 GPS
129 clip
130 elongated vertical wall mount structure
131 strap
132 cover arm
133 support
134 holes
136 contact
137 plug
138 transformer
139 contact

140 controller
141 motor
142 sensor
143 batteries
144 light
145 alarm
146 transmitter/receiver
147 antenna
148 fluffing mechanism
149 button
150 chuck
151 elongated end
152 fingers
160 computer
161 microphone
162 message
163 microphone
165 speaker
166 transmitter/receiver
167 received
168 display
169 data
170 nut
171 outer ring
172 door
173 tab
174 speaker
175 microphone
176 quantum dot(s)
179 phone
180 extinguisher icon
181 extinguisher icon
182 extinguisher icon
183 relative scale
190 display
191 extinguisher
192 extinguisher
193 status
194 building
195 location FIG. 1 an isometric view of the self-reliant fire extinguisher 10, mounting bracket, fluffing wheel and the fluffing chuck. The chamber 20 is substantially a cylindrical shape with a bottom 22 and a top 30. In the preferred embodiment the chamber is molded from a lightweight resilient material, but it is further contemplated that the chamber be made of aluminum, steel, brass or copper. The preferred embodiment of plastics allows the extinguisher to be placed in locations that could cause corrosion of metals. The top 30 is screwed onto the chamber, but it could also be attached with a bayonet or latching mechanism. The top 30 fits on top of an enlarged opening 72 on the chamber to allow easier filling of the chamber 20 with fire retardant materials. A wall hanging mechanism can be incorporated into the top of the extinguisher, wrap around the body of the cylinder or fork the top of the extinguisher. In this figure the fire extinguisher is shown with a wall mounting mechanism where the fire extinguisher sits on top if the bracket. The bracket is described with more detail below. A handle 40 allows the operator to hold the extinguisher in an upright orientation when it is being used. The fire extinguisher can also be stored and or transported in the upright orientation, but the upright orientation is not critical for the storage or operation of the extinguisher. Within the handle 40 a pressurized canister 50 is located. While in the preferred embodiment the pressurized canister is shown within the handle other locations such as within the top of the extinguisher or adjacent to the hose are contemplated.

The canister 50 consists essentially of a pressurized chamber, but canisters of different types of gas are possible that do not promote spreading of the fire. Because the gas within the canister is under high pressure or in a liquid state, a small canister of pressurized gas is required to expel the contents of the chamber 20. It is also contemplated that multiple pressurized canisters can be placed within the handle to accommodate a larger fire extinguisher without deviating from the inventive nature of the design. Pressurized canisters are available from a variety of sources and can be replaced or serviced without the need to service the entire fire extinguisher. The handle 40 provides some protection to the canister in the event the fire extinguisher is dropped or roughly handled. A cover 42 protects the gas cartridge. The handle 40 to provide structural strength to the top of the fire extinguisher as well as providing a hole for gripping. A rotating mechanism 64 on the back of the fire extinguisher is rotated to allow the trigger 60 to be lowered to charge the fire extinguisher. The trigger mechanism opens the pressurized canister to pressurize the chamber and expel the fire extinguishing media out the front of the extinguisher out the application nozzle 90.

The location of the activation trigger on the fire extinguisher provide a fire extinguisher that is designed with both the safety pin and the hose retainer for ease of access for right and left handed person. Since the majority of individuals are right handed this creates real problems in life threatening situations. The trigger on top of the fire extinguisher and requires the operator to press down on the extinguisher to operate the extinguisher, but other embodiments are contemplated including but not limited to a finger trigger or a slide mechanism. A safety pin can be incorporated to prevent accidental operation of the extinguisher. The extinguisher is hung from a wall using a fork type holder that is not shown. It is further contemplated that the top housing has an extended tab on one or more side for hanging on an existing wall hanger. The extended tab includes a variety of details located on the top and sides of the extended tab for mounting on wall hangers that are available with older fire extinguisher.

The extinguisher has a powder release valve 80 that is rotated to open the nozzle 90. This valve can be rotated back to the closed position to prevent extinguishing powder from pouring out of the extinguisher when not desired. The path from the pressurized canister 50 to the nozzle 90 is best shown and described in FIG. 5.

Figure 2:
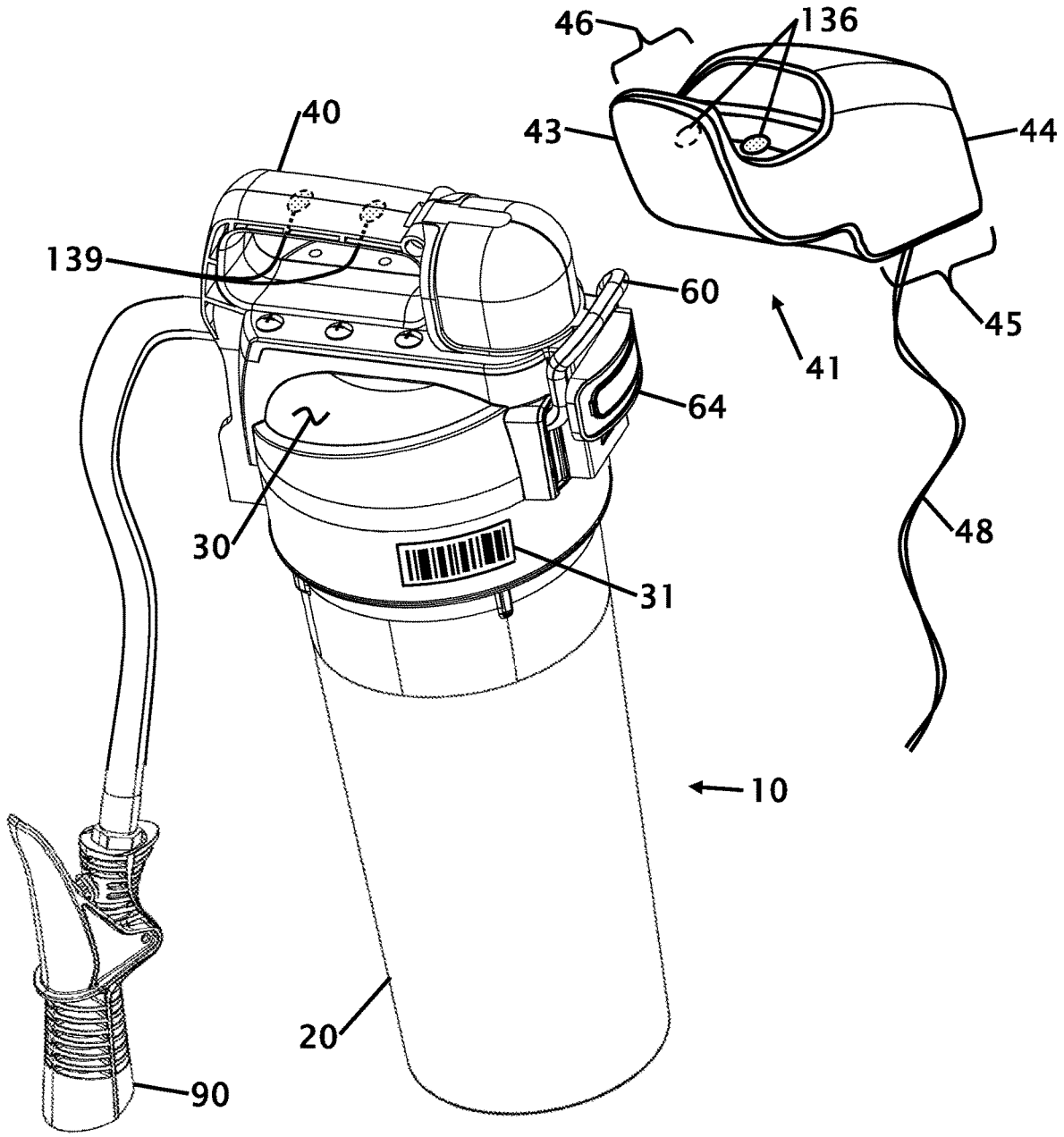
FIG. 2 shows an alternate embodiment of the self-reliant fire extinguisher and mounting bracket.

FIG. 2 shows an alternate embodiment of the self-reliant fire extinguisher 10 and mounting wall bracket 41. The self-reliant fire extinguisher 10 is shown with the lower chamber 20 secured to the top housing 30. This figure shows a bar code 31 that identifies the specific fire extinguisher without requiring access to a computer of other cellular or computing device to differentiate one fire extinguisher from another. The bar code can be scanned buy barcode scanner, cell phone or tablet, or a number can be placed onto the barcode to make the number human readable.

In this embodiment the wall mount 41 allows the user to "hook" the fire extinguisher 10 onto the wall mount 41. A user simply hooks the handle 40 of the fire extinguisher onto the front lip 43 of the wall mount 41. The wall mount 41 has a front lip 43 to retain the handle 40 of the fire extinguisher 10 within the saddle 46 area. The wall mounting further spaces 45 the body of the fire extinguisher 10 away from the wall. The back 44 of the wall mount 41 is flush and has mounting features that are shown and described in other images herein. Within the wall mount 41 are a plurality of contact 136 that make contact with complimentary contact 139 in the underside of the handle 40 of the fire extinguisher 10. The contacts 136 and 139 are used to charge or maintain a charge of the self-reliant fire extinguisher 10. While contacts are shown and described, the charging can also be performed with inductive coils in the wall mount 41 and the fire extinguisher 10. A power cord 48 connects from the wall mount 41 to an electrical outlet or power adapter (not shown).

From this figure access to the tamper device rotating mechanism 64 and the trigger 60 is still available as well as access to the exit nozzle 90. In theory a user can charge and operate the fire extinguisher while the fire extinguisher is still retained on the wall mount 41.

Figure 4:
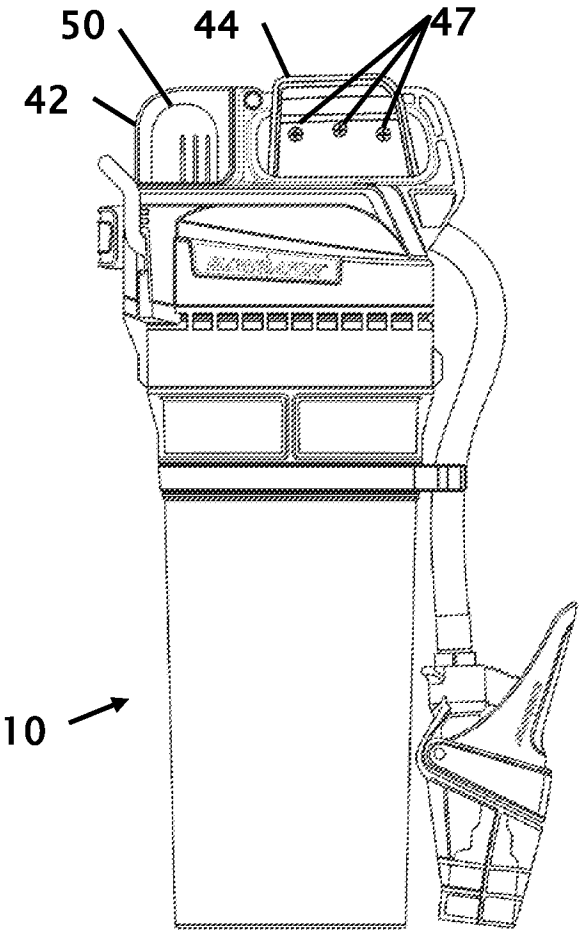
FIG. 4 shows the self-reliant fire extinguisher on the mounting bracket.
Figure 3:
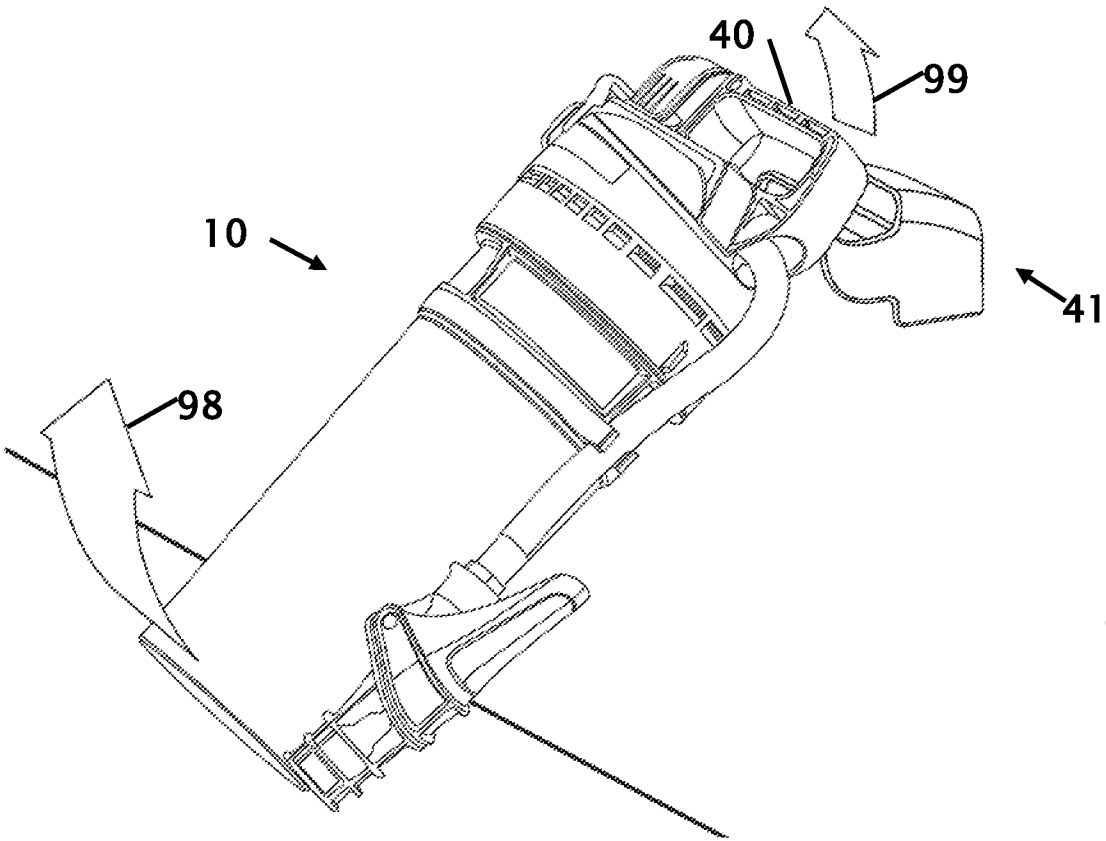
FIG. 3 shows the embodiment of the self-reliant fire extinguisher and the mounting bracket from FIG. 2 where the self-reliant fire extinguisher is being installed onto the bracket.

FIG. 3 shows the embodiment of the self-reliant fire extinguisher 10 and the mounting bracket 41 from FIG. 2 where the self-reliant fire extinguisher 10 is being installed onto the bracket 41 and FIG. 4 shows the self-reliant fire extinguisher 10 on the mounting bracket 41. To install the fire extinguisher 10 onto the bracket 41. The bottom of the fire extinguisher 10 is rotated 98 and then the handle 40 is aligned with the front lip of the bracket 41. The fire extinguisher 10 is then lowered onto the bracket 41. Removal of the fire extinguisher 10 in reverse order where the bottom of the fire extinguisher 10 rotated 98 and then the fire extinguisher 10 is lifted 99.

In the back view from FIG. 4, the back of the bracket 44 is shown with mounting screws 47. In this view, the transparent cover 42 over the gas canister 50 allows for inspection of the fire extinguisher 10. This allows inspection without removal of the fire extinguisher 10 from the wall mount 41.

Figure 5:
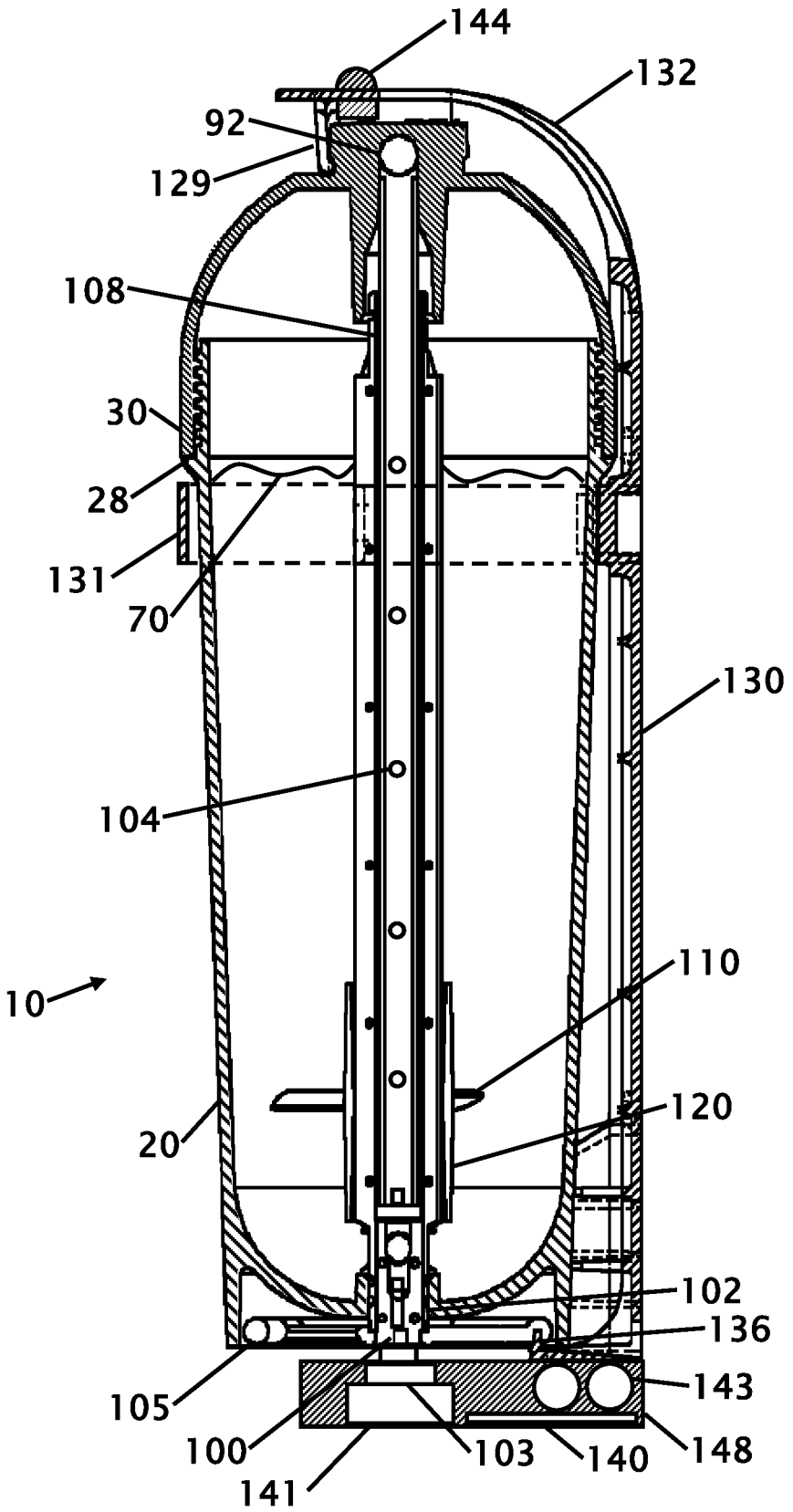
FIG. 5 shows a side sectional view of the self-reliant fire extinguisher, in a captured mounting bracket.

FIG. 5 shows a side sectional view of the self-reliant fire extinguisher, mounting bracket and the fluffing wheel shown in FIG. 1. This figure shows the chamber 20 filled with the fire extinguishing media 70 such as chemical retardant ABC, BC, Purple K etc. Various types of fire extinguishing media can be placed within the chamber. The upper portion of the chamber includes an enlarged opening 28 where it joins with the top 30 of the extinguisher. The fire extinguishing media is embedded with quantum dots that can be monitored or queried to determine potency of said fire extinguishing media. The quantum dot particles provide a confirmation that the fire extinguishing media is the required quality and retains the UL requirements without being tampered. This also ensures that the fire extinguishing media is not diluted or mixed with other fire extinguishing media that would compromise the effectiveness of the fire extinguishing media.

The enlarged opening 72 is greater than 50% of the diameter of the cylindrical fire extinguisher, but could be up to and including the same diameter as the cylinder with a threading mechanism located on the exterior lip of the cylinder at one or both ends of the cylinder. Threading or other fastening means is used to secure the top 30 and or bottom of the fire extinguisher onto the cylinder. The fastening means can be with internal or external threading on the cylinder and mating end closures or by methods of fastening such as but not limited to bayonet, pins, welding or adhesives. It is also contemplated that the cylinder be fabricated from tubular stock where both the top and the bottom of the extinguisher is identical and the ends are attached to the tube when the fire extinguisher is assembled. The bottom of the extinguisher 20 has a port, hole or opening 102 to allow access to the fluffing knob 105. In the preferred embodiment the top opening is between 75% and 90% of the diameter of the fire extinguisher. The larger opening allows the contents of the fire extinguisher to be filled, emptied, inspected, and serviced more easily. The top is screwed onto the chamber, but it could also be attached with a bayonet or latching mechanism. The top 30 of the fire extinguisher 10 provides the propellant and the connections to emit the fire suppressant media 70.

In this FIG. 5, the chamber is shown to provide a view of the fluffing mechanism(s) 120. The fluffing mechanism conditions the fire-retardant media to provide anti-bridging of the media within the chamber to agitate, fluff, turn, disturb, stir, ruffle, and or alters the condition of the media to allow the media to maintain a powder consistency. This allows the fire-retardant powder media to remain in a liquefied state so it is easier to spray the powder onto a fire. The conditioning of the media can be performed using a variety of methods and in the preferred embodiment the conditioning is performed with an appendage 110 that can be articulated from the exterior of the chamber where it terminates 100. The appendage is a shaft that extends the length of the chamber and has a number of flaps or appendages 110 attached to the appendage. While flaps are shown and used in the preferred embodiment a variety of other appendages are contemplated that can condition the media that include but are not limited to rods, paddles, arms, disks, cable, chains or combination thereof. It is also contemplated that the appendage can be a simple hook or chain that conditions the fire extinguishing media. When the trigger is activated the pressure in canister 50 (FIG. 1) is released into the chamber and the fire suppressant media 70 is pushed through holes 104 in the central fluffer shaft 108 where it is pushed out hole 92 than exiting out the nozzle 90 (FIG. 1).

The fluffer is formed from two halves of material that is joined to create the fluffing shaft. It is contemplated that the fluffing can be accomplished by blowing gas into the chamber through a hole and through the fluffing shaft to fluff the media within the chamber where the gas blows through the shaft and out fluffing holes 104. As previously described the appendage terminates 100 at the bottom of the chamber with a drive fitting where it can be articulated, but the appendage could terminate at the top or sides of the chamber. The termination at the bottom of the chamber where it terminates 100 to allow articulation that requires either a key to attach to the appendage, or may terminate with manual knob, handle, wheel or other extension. A manually rotatable handle is shown for manual fluffing of the fire extinguishing media.

Referring back to FIG. 1 the head (delivery system) has an emission port and an entry port plus a pick-up tube. It has a safety guard rotating mechanism 64 over the charging pin and a lever trigger 60 to fire the powder through the emission port. The powering cartridge 50 is easily installed in the handle 40 attached to the head of the extinguisher. The powder cartridge has a fluffier tube with an opening to accept the pick-up tube within the head. Current fire extinguishers must be torn down every six years to fluff the powder, check for caking and to check the condition of the chemical. This extinguisher does not have to be broken down; the powder can be fluffed each month, once a year or the chemical cartridge can simple be replaced. The current fire extinguishers have to be subjected to a hydro test every five years for fleet vehicles and every twelve years for the standard extinguishers.

The nozzle 90 can be turned to direct the spray of fire-retardant material as desired. A handle valve 80 is rotated up to allow the fire extinguishing media to be expelled and rotated down to block the flow of fire-retardant material from falling out of the extinguisher when the tank is tipped. The nozzle is shown in a fixed direction but in another contemplated embodiment the nozzle is flexible to allow a user to hold the fire extinguisher and direct the fire extinguishing media out of the nozzle to a fire. While a nozzle is shown in the preferred embodiment other dispensing orifices can be used such as valves, tubing, spray nozzles or similar are contemplated. It is contemplated that an over pressure relief valve can be incorporated within the fire extinguisher to vent any excessive pressure from within the cylinder that could cause the fire extinguisher to burst due to over pressurization of the chamber.

The mounting bracket is shown without the fire extinguisher installed in FIG. 1 and in cross section in FIG. 5. The bracket is an elongated vertical structure 130 for mounting on the face of a vertical wall. Holes 134 allow the structure to be mounted directly to a wall or similar structure. A horizontal supporting base support 133 extends essentially horizontal from the lower portion of the elongated vertical structure 130 for supporting the bottom of a fire extinguisher. A cover arm 132 extends from the upper portion of the elongated vertical structure to a position over at least a portion of the top of the fire extinguisher placed on the horizontal supporting base such that the arm covers the firing safety trigger 60 and the powder release valve 80.

When the fire extinguisher is installed on the bracket a tab contact 136 extends vertically from the bottom support 133 and extends under the bottom housing of the fire extinguisher. Another clip 129 wraps around the top of the extinguisher to hold the extinguisher inside the bracket. A powered fluffing mechanism 148 is shown on the bottom of the bracket. The mechanism shown in FIG. 1 shows batteries 143 for a power source but it is also contemplated that the power can come from a wound clock spring type motor. A motor 141 is shown connected to a transmission 103 that is connected either directly to the bottom drive mechanism where the chamber terminates 100 at the fluffing shaft mechanism 120 or to an intermediary fluffing knob 105. A circuit board controller 140 is shown in FIG. 2 that provides control for an alarm, a visual indicator light 144 and control of the motor 141.

The circuit board can include environmental sensors that can transmit local environmental conditions, such as but not limited to, temperature, humidity, CO2, SO2, CO, pressure, temperature and Global Positioning System (GPS) location. This transmitted data can be received by a PC, laptop, tablet, cell phone, phone, wearable or similar device to provide a drawing of one or more fire extinguishers in a facility. This information can be shown numerically or graphically to see the temperature across the facility and display the location and status of the fire extinguisher unit along with condition information at the facility including, but not limited to, temperature and air quality. The information can be used to pinpoint to potential users of where a fire extinguisher is located, the type of fire extinguishing media and the capacity of the fire extinguisher, as well and identify where fire extinguishers have been used to prevent a user from searching a location by providing a precise location of the fire extinguisher for facility and safety personnel.

A strap 131 wraps around the fire extinguisher and snaps into the bracket to retain the fire extinguisher 10. FIG. 1 shows one contemplated design of a fluffer knob 105. The knob is a flattened toroidal shaped body with a plurality of elongated arms 106 extending horizontally from the flattened plainer toroidal shaped body. A geometric opening 101 that is concentric with the flattened toroidal shape is used to attach the knob 105 to the fire extinguisher having external powder fluffing capability.

A chuck 150 is shown in FIG. 1 where the elongated end 151 of the chuck 150 is configured for use with a conventional drill. The chuck 150 has a number of fingers 152 that engage in the arms 106 of the fluffing knob 105.

Figure 6:
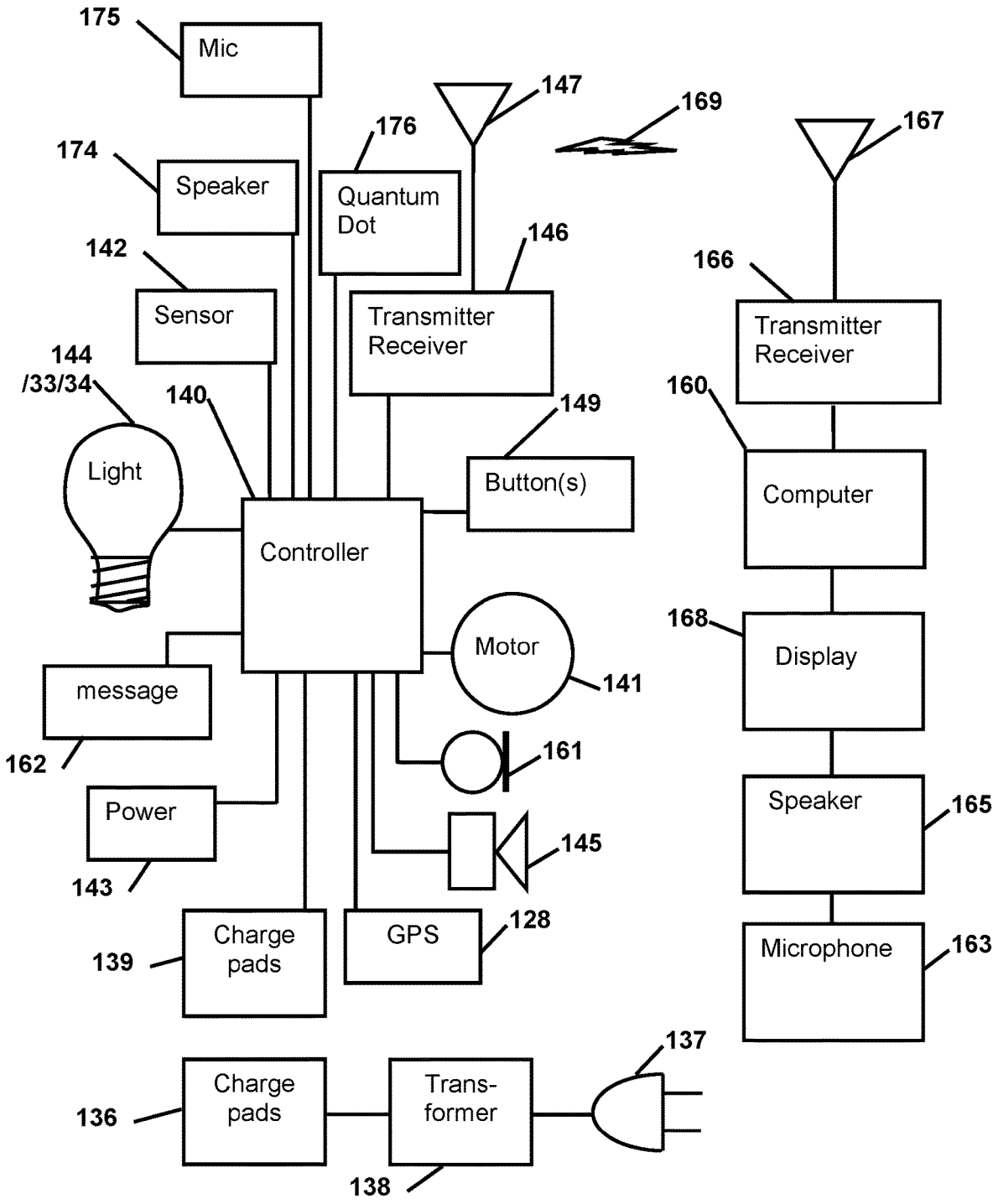
FIG. 6 shows block diagram of the electronic circuit for the control, drive and signaling mechanism.

FIG. 6 shows block diagram of the electronic circuit for the control, drive and signaling mechanism. This block diagram is one contemplated configuration having a central controller 140. The central controller 140 may include electronics that periodically activate the motor 141 to turn the fluffer for a temporal period of time. One or more sensors 142 detect tampering or use of the fire extinguisher and can turn on lighting 33, 34, 144, and alarm 145 or transmitter/receiver 146 a signal to another location using a wireless antenna 147 or wired connection. The signal may include a location where the extinguisher was located, or other encoded information that provides information regarding the particular fire extinguisher including when it was serviced or fluffed. Another sensor or button 149 is used to manually activate the motor or the test the device. The fire extinguisher also has a speaker 174 and a microphone 175 so a user can hear verbal instructions and can have a two-way communication with others. In the preferred embodiment the power is supplied by one or more batteries 143 that are replaceable, rechargeable or solar charged.

If the circuit is integrated with a fire extinguisher, it is contemplated that charge pads contact 139 can exist on the fire extinguisher to keep the controller 140 powered. In this embodiment complimentary charging pads or pins contact 139 are located on the wall mount. The charge pads or pins are connected to a transformer 138 or other power conditioner that is connected to an electrical outlet plug 137.

The housing can include environmental sensors 142 that can transmit local environmental conditions, such as but not limited to, temperature, humidity, CO2, SO2, CO, pressure, temperature and GPS 128, longitude, latitude, elevation and address location. This information can be used to provide real-time information regarding the location of the fire extinguisher, environment around the fire extinguisher and the status of the fire extinguisher without requiring a visual observation or a person physically being in the vicinity of a single fire extinguisher or multiple fire extinguishers placed around a facility. This information can be displayed on a map to provide graphical or numerical information at a distant location so a fire fighter can obtain an overall understanding where a fire or hotspot exists to obtain an overall understanding of where the extinguisher is and given the proximity of the unit to the fire, additional information about the conditions in the surrounding area like temperature and air quality.

This transmitted data 169 can be received 167 by a transmitter/receiver 166 on or in a PC, laptop, tablet, cell phone, computer 160 or similar device to provide a drawing or digital image on a display 168 of one or more fire extinguishers in a facility. The wired or wireless data 169 can be sent using various type of transmission including, but not limited to, Bluetooth, Wi-Fi, LAN, WAN, FM and cellular networks. The communications can be sent at timed intervals or when triggered when an event or status change takes place near the fire extinguisher or with the fire extinguisher. The application can be used to remotely initiate or activate fluffing the fire extinguisher at a set interval, and signal in advance or just prior to a user accessing the fire extinguisher.

The button(s) 149 or sensor(s) 142 can also be used to determine when the fire extinguisher has been removed from wall mount 41 (not shown in this figure). When removal is detected a message 162 can be played through the speaker 145 to provide instructions on how to use the fire extinguisher. The sensor(s) 142 can determine progress of the user to charge and use the extinguisher. There may be written instructions on how to activate the speech instructions of operation or the extinguisher can detect actions of a user to continue to prompt an instruction or move to a next set of instructions when the fire extinguisher detects that the user has completed a step of operation. The message 162 can be in one or more spoken languages. As an example, when the fire extinguisher is first removed the spoken instructions message 162 can instruct the user to first rotate the rotating mechanism 64. Once a sensor determines that the rotating mechanism 64 has been rotated, the spoken instructions message 162 can tell a user to rotate the trigger 60. Another sensor can then determine that the chamber has been pressurized and then the spoken instructions message 162 can direct a user to point the nozzle 90 at the fire and depress the lever of the valve 80. As the fire extinguisher is being used the spoken instructions message 162 can provide information about the amount of fire extinguishing media that is remaining in the fire extinguisher.

A microphone 161 and speaker 145 on the fire extinguisher allows a user to talk or interface with a microphone 163 and speaker 165 at the receiver. The communications can include a speaker the fire extinguisher can provide safety, music and public service announcements using a wireless WiFi communication network without requiring separate speakers to be wired and connected throughout a building. When the transmitter/receiver 166 is a cellular device like a phone, tablet or computer the person at the receive can be mobile while they communicate to a single person at a fire extinguisher or a group of fire extinguishers. When the transmitter/receiver 166 is embedded in a cellular mobile device or a device with wireless connectivity (like a phone, tablet, laptop computer or even watch), the person can be remote from the facility and communicate to the local person or personnel at the facility through the fire extinguisher or within the context of the group of extinguishers.

The fire extinguishing media can be embedded with quantum dots 176 that can be monitored or queried to determine potency of said fire extinguishing media. The quantum dot 176 particles provide a confirmation that the fire extinguishing media is the required quality and retains the UL requirements without being tampered. This also ensures that the fire extinguishing media is not diluted or mixed with other fire extinguishing media that would compromise the effectiveness of the fire extinguishing media. The quantum dots 176 can be monitored by the controller 140 and or can be read by the receiver 166. The quantum dots 176 can also provide information about the temperature and pressure within the fire extinguisher housing where the fire extinguishing media is stored.

The temperature and other relevant information can be transmitted about the extinguisher and/or facility conditions and displayed in alpha numeric formats and graphically to see the temperature across the facility. The information can be used to pinpoint to potential users where a fire extinguisher is located, the type of fire extinguishing media and the capacity of the fire extinguisher, as well and identify where fire extinguishers have been used to prevent a user from searching a location where the fire extinguisher has been used. This can be provided with a computer program or software application so a smart-phone being used by a person or fireman can identify the location of a fire extinguisher and direct the person of fireman in a unfamiliar building or where entry into a facility with limited visibility in a building where the person or fireman has never previously entered, or enters a building filled with smoke with limited visibility. The application can provide the person with a phone a real-time location map with the precise location of the fire extinguisher, a real-time map of the location of the person with a phone and the location of the fire extinguisher.

Figure 7:
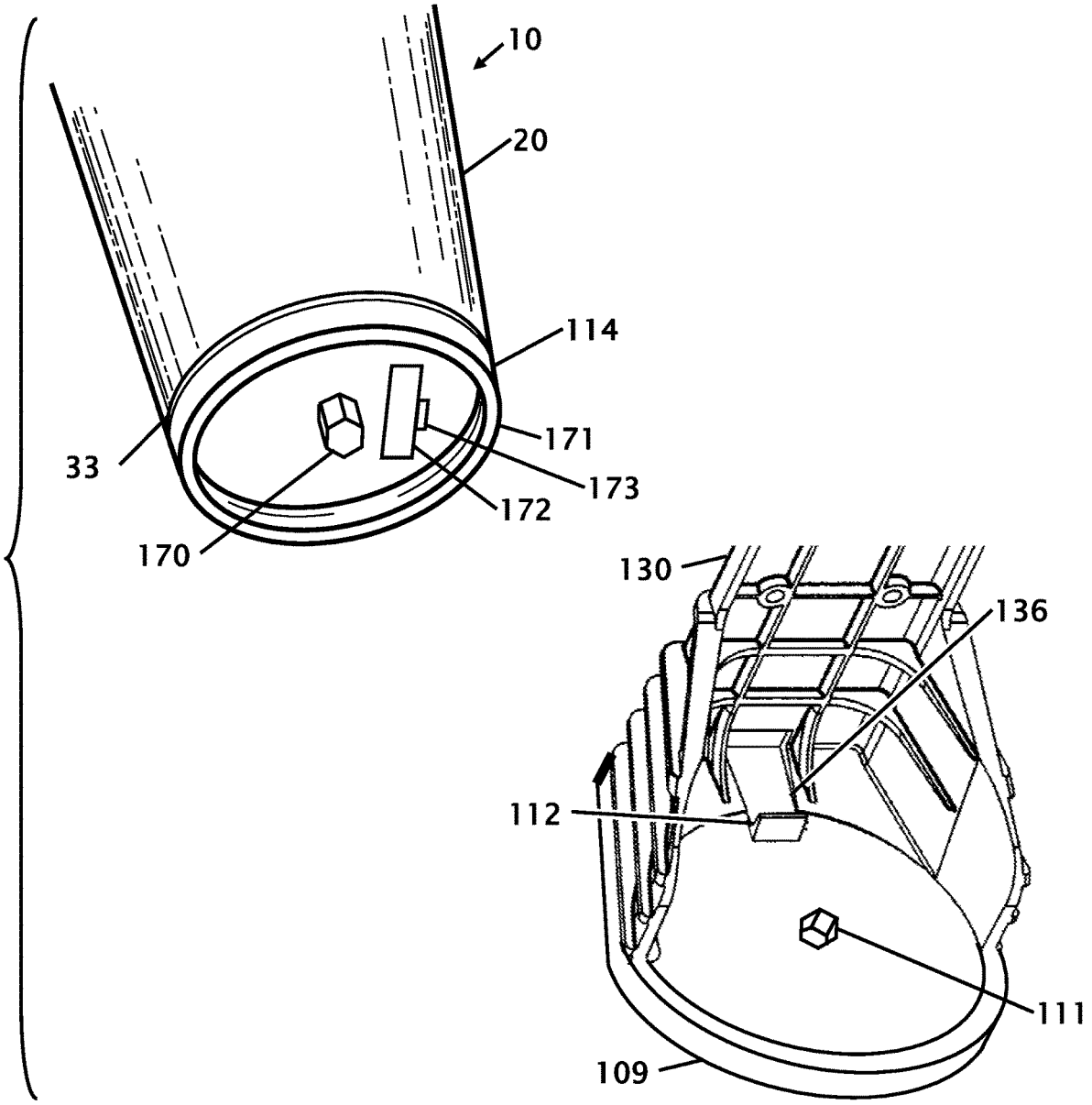
FIG. 7 shows the electrical charging connection between the fire extinguisher and the wall mount.

FIG. 7 shows the electrical charging connection between the fire extinguisher 20 and the elongated vertical wall mount structure 130. To provide charging from the wall mount 130 to the fire extinguisher 10. In one embodiment the electrical charging connection is with a central connection between the base 111 at and the fire extinguisher bottom nut 170. The second electrical connection is from tab contact 136 at the riser 112 that contacts the outer ring 171 of the fire extinguisher 10. In another contemplated embodiment the charging can be inductively coupled from the bottom 109 of the elongated vertical wall mount structure 130 to the bottom of the fire extinguisher 10.

The bottom of the fire extinguisher shows a battery access door 172 with a tab 173 for opening the battery access door. The smart communication device and communication capability can be integrated into the housing of the fire extinguisher 10 or can be added or secured 114 to an existing fire extinguisher to provide monitoring and tracking. The smart communications part of the fire extinguisher may have an illumination ring 33 that illuminates when the fire extinguisher is removed from the elongated vertical wall mount structure 130. The intensity of the illumination can be adjustable and it is contemplated that when a fire alarm in a building is activated the illumination band 33 can illuminate or flash to aid in locating the fire extinguisher 10. Once the extinguisher 10 is removed from the elongated vertical wall mount structure 130, the intensity of the lighting can be reduced. It is further contemplated that sensors include a pressure sensor 142 (shown in FIGS. 4 and 6) that monitors the pressure within the extinguisher 10 to determine if the fire extinguisher has been pressurized and the amount of fire extinguishing media that remains in the fire extinguisher 10.

Figure 8:
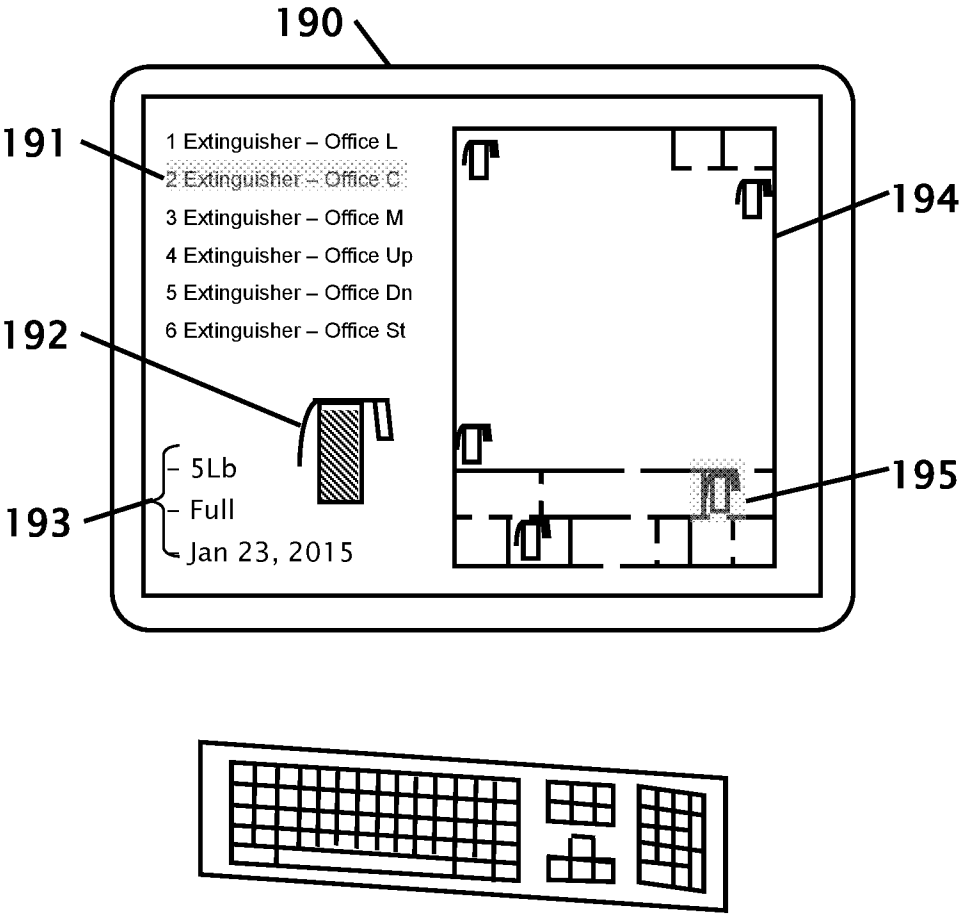
FIG. 8 shows a computer display with the information from the fire extinguishers.

FIG. 8 shows a computer display 190 monitor (computer, tablet, mobile device) with the information from the fire extinguishers. Each extinguisher has a unique identifier. The identity and status of each extinguisher is available. The computer display 190 shows a layout of the building 194 with a pictorial location of the fire extinguishers. In this display, a user has selected a specific fire extinguisher 191. A graphical image of the fire extinguisher 192 is shown with the status 193 of the fire extinguisher 192 that image of the building 194 also shows the location 195 of the fire extinguisher.

Figure 9:
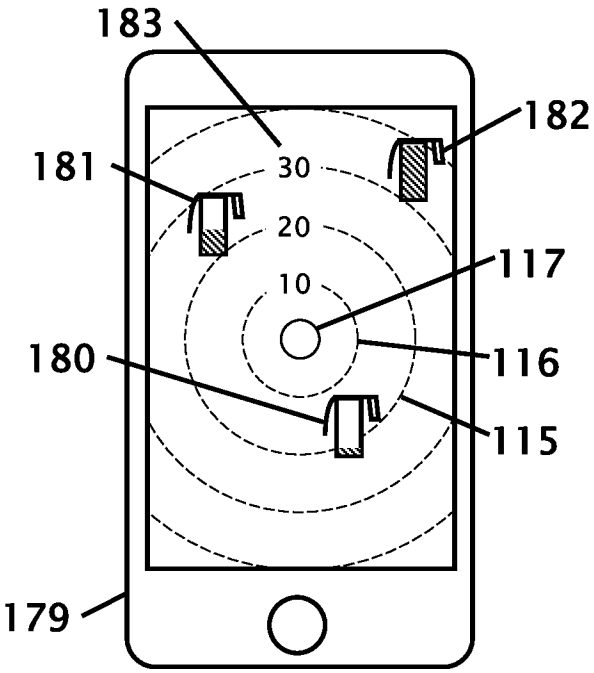
FIG. 9 shows a cellular phone or tablet with information on the fire extinguishers.

FIG. 9 shows an example of a cellular phone 179 or tablet with information on the fire extinguishers. This application shows the location 117 of the phone 179 in the center of the display. Concentric rings 116, 115 etc. provide a relative distance from the phone to fire extinguishers. In this display, three fire extinguishers 180, 181 and 182 are shown at a relative distance from the location of the phone 179. Each graphical icon fire extinguisher 180, 181 and 182 shows a marking within the cylinder that shows the level of charge in each extinguisher. In this example, extinguisher 182 appear full, while extinguisher 180 appears nearly empty. The location of each fire extinguisher 180, 181 and 182 is known by the GPS locator within each extinguisher. The GPS location of the cellular device is known by the GPS locator within the cellular device. The user can zoom the display to change the relative scale 183. This enables a person to locate a fire extinguisher in a smoke-filled area without having any knowledge of the area. It is further contemplated that each fire extinguisher can display color or the temperature local to the fire extinguisher to determine the safety at each extinguisher.

Other contemplated embodiments include the use of barcodes or Near Field communication (NFC) chip for the delivery head assembly. Some computer and phone manufacturers are using Application Programming Interface (API) of their built-in chips which allows for mobile to mobile communications. Electronics manufacturers of phone, computer and other electronic devices are providing Application Programming Interfaces to these devices and through customizable chip technologies allowing for build out of secure reliable connections and the development of specific applications to integrate and pass data and commands back and forth between devices and locations.

The fire extinguisher and the application can utilize this hardware in computers, tables and phones. The end user at the facility will be able to locate and read the status with unprecedented accuracy to integrate and develop purpose built application capability to better support fire safety and response.

Computer manufactures are developing business apps. This is in anticipation of the next generation of devices coining down the pipeline for the smart, connected, intelligent enterprise. There is a growing environment among developers to meet the needs of enterprise in increasing ways. The application that operates in support of the fire architected and designed in a fashion to support a variety of communication protocols and standards that will enable to incorporation of Near Field Communications (NFC) services as a component of the device. with the fire extinguisher is designed to incorporate the NFC component of the device.

It is also contemplated that the application can read the geotag hidden beneath each photo or scan taken that the application on the mobile device a can read and scan the unit and geotag each unit to a map location providing real time GPS information to the user for each of the units. This gives the application and servers real time GPS information for each scanned component. The end user can turn on their location services from the settings of their phone or tablet. This alert pops up when the user does the initial scan requesting location services be enabled. The location services will need to be enabled for accurate tracking of geo location information and other status. The app will not move forward without location services being turned on.

Thus, specific embodiments of an improved fire extinguisher have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A smart fire extinguisher comprising:

a manually transportable fire extinguisher;

said manually transportable fire extinguisher having a housing with an internal power supply that is charged with a separable wall mounting bracket;

said separable wall mounting bracket being a wall mounted charger that allows said manually transportable fire extinguisher with said internal power supply to hang from said wall mounting bracket to charge said manually transportable fire extinguisher;

said internal power supply powering a microcontroller within said housing of said manually transportable fire extinguisher;

said housing of said manually transportable fire extinguisher includes said microcontroller, at least one sensor, a speaker, at least one transmitter/receiver and at least two messages;

said at least one transmitter/receiver transmits with a wireless communication selected from a group consisting of Bluetooth, Wi-Fi, LAN, WAN, FM and cellular network;

a signaling mechanism on said manually transportable fire extinguisher is activated when said manually transportable fire extinguisher is removed from said wall mounting bracket and a first message is played from said speaker in said housing of said manually transportable fire extinguisher for instructions how to override a tamper device on said said manually transportable fire extinguisher;

when said at least one sensor in said manually transportable fire extinguisher detects that a user has overridden said tamper device on said manually transportable fire extinguisher, a second message is played from said speaker in said housing in said manually transportable fire extinguisher that provides further instructs for pressurizing said manually transportable fire extinguisher;

a pressure sensor within said manually transportable fire extinguisher monitors a pressure within said manually transportable fire extinguisher and when said manually transportable fire extinguisher is pressurized, said manually transportable fire extinguisher plays a third message for depressing a powder release valve to use said manually transportable fire extinguisher.

2. The smart fire extinguisher according to claim 1, further includes an environmental sensor that senses an environmental condition that is selected from a group consisting of humidity, CO2, SO2, CO and temperature.

3. The smart fire extinguisher according to claim 1, wherein said wireless communication is received by a receiver selected from a group consisting of a PC, a laptop, a tablet, a mobile electronic device, a watch or a cell phone.

4. The smart fire extinguisher according to claim 3, wherein said receiver operates with an application or a program to provide alpha numerical or graphical information received from said manually transportable fire extinguisher.

5. The smart fire extinguisher according to claim 4, wherein said application or said program provides a real-time map of a location of said mobile device and said manually transportable fire extinguisher.

6. The smart fire extinguisher according to claim 1, wherein said manually transportable fire extinguisher provides information about said manually transportable fire extinguisher from a group consisting of, fire extinguishing media and capacity of said manually transportable fire extinguisher.

7. The smart fire extinguisher according to claim 1, wherein the signaling mechanism include at least one of a light, audible alarm or a wireless transmitted signal.

8. The smart fire extinguisher according to claim 1, wherein said manually transportable fire extinguisher further includes an illumination ring that illuminates around a bottom of said manually transportable fire extinguisher that is configured to illuminate a floor under said manually transportable fire extinguisher and around said manually transportable fire extinguisher.

9. The smart fire extinguisher according to claim 8, wherein said illumination ring is illuminated when said manually transportable fire extinguisher is removed from a mounting base.

10. The smart fire extinguisher according to claim 8, wherein said illumination ring is illuminated when said manually transportable fire extinguisher receives a wireless signal a fire alarm is activated or a fire is detected.

11. The smart fire extinguisher according to claim 8, wherein said illumination ring flashes when a fire alarm is activated or a fire is detected.

12. The smart fire extinguisher according to claim 1, wherein said pressure sensor determines an amount of fire suppressing media in said manually transportable fire extinguisher and provides fourth spoken message for information updates on an amount of fire extinguishing media is remaining said manually transportable fire extinguisher.

13. The smart fire extinguisher according to claim 1, further includes a global positioning sensor that is configured to provide information on location and movement of said manually transportable fire extinguisher.

14. The smart fire extinguisher according to claim 13, wherein said location is with an application that displays position of said manually transportable fire extinguisher relative to a mobile device.

15. The smart fire extinguisher according to claim 1, wherein said charging is with contacts in said wall mount bracket and said manually transportable fire extinguisher.

16. The smart fire extinguisher according to claim 1, whereby said transmitter transmits data at timed intervals or when a change takes place near said manually transportable fire extinguisher.

17. The smart fire extinguisher according to claim 1, wherein said speaker in said housing on said fire manually transportable extinguisher speaker receives and plays public address information and/or music.

18. The smart fire extinguisher according to claim 1, wherein said manually transportable fire extinguisher further includes a microphone.

19. The smart fire extinguisher according to claim 18, wherein said manually transportable fire extinguisher is configured to allows for bi-directional communication between said manually transportable fire extinguisher and a mobile device.

* * * * *